US005406234A

United States Patent [19]

Willems

[11] Patent Number: 5,406,234

[45] Date of Patent: Apr. 11, 1995

[54] TUNABLE MICROWAVE FILTER APPARATUS HAVING A NOTCH RESONATOR

[75] Inventor: David A. Willems, Salem, Va.

[73] Assignee: ITT Corporation, New York, N.Y.

[21] Appl. No.: 227,189

[22] Filed: Apr. 13, 1994

Related U.S. Application Data

[63] Continuation of Ser. No. 998,831, Dec. 30, 1992, abandoned.

[51] Int. Cl.[6] ..... H01P 1/205

[52] U.S. Cl. ..... 333/203; 333/235

[58] Field of Search ..... 333/202–207, 333/219, 219.1, 235

[56] References Cited

U.S. PATENT DOCUMENTS

| | | | |
|---|---|---|---|
| 3,889,214 | 6/1975 | Petitjean et al. | 333/203 |
| 4,596,969 | 6/1986 | Jachowski | 333/203 |
| 4,721,931 | 1/1988 | Nishikawa et al. | 333/203 |

FOREIGN PATENT DOCUMENTS

| | | | |
|---|---|---|---|
| 0018260 | 2/1979 | Japan | 333/202 |
| 0020638 | 2/1979 | Japan | 333/203 |
| 1191984 | 5/1970 | United Kingdom | 333/203 |

OTHER PUBLICATIONS

Davis, "Microwave Semiconductor Circuit Design", Van Nostrand Reinhold Company, Inc., pp. 50–93.

*Primary Examiner*—Seungsook Ham

*Attorney, Agent, or Firm*—Arthur L. Plevy; Patrick M. Hogan

[57] ABSTRACT

There is disclosed a tunable notch filter which has a bandpass characteristic and where a tunable notch is added to the bandpass filter by placing a resonator outside the input or output probe of the bandpass filter. The bandpass filter is a resonant type of filter and comprises a plurality of parallel, spaced apart resonators. The tunable notch resonator is positioned near the input or output probe and operates to direct a substantial amount of energy from the filter at the frequency at which the notch resonator is tuned. In this manner a notch is created within the bandpass characteristic of the filter and which notch resonator can be tuned to provide the notch anywhere in the filter passband or above or below the band edges.

16 Claims, 3 Drawing Sheets

TUNABLE MICROWAVE FILTER APPARATUS HAVING A NOTCH RESONATOR

This is a continuation of application Ser. No. 07/998,831, (abandoned), filed on Dec. 30, 1992, entitled TUNABLE MICROWAVE FILTER APPARATUS.

FIELD OF THE INVENTION

This invention relates to microwave filter apparatus in general, and more particularly, to a bandpass microwave filter apparatus having an integral tunable notch filter.

BACKGROUND OF INVENTION

As one can ascertain, filters are widely employed to provide a desired specified response to a given input signal. Most filters are used to allow certain frequencies to be transmitted to the output load whine rejecting the remaining frequencies. Many designs demand not only a specified amplitude response, but a specified phase response as well. Filters can be designed in either the frequency domain or the time domain, although the former approach is the more fully developed. The design of microwave filters owes much to the progress made in the design of lumped parameter filters. Thus there are many texts that refer to design techniques for various types of microwave filters.

Almost all electronic systems use filters including systems at microwave frequencies. Microwave filters basically differ in construction from lumped filters which operate at lower frequencies because wire inductors have high losses (i.e. low Q factors) at microwave frequencies and, therefore, are impractical. Typically low-loss high-performance microwave filters use quarter-wavelength long structures such as waveguide cavities, transmissions lines or hybrids of both to form resonators in lieu of employing inductors and capacitors. These resonators when coupled together provide a frequency dependent response or filter response. Filters made employing prior art techniques can be quite large, for example, at 3 GHz a quarter-wavelength is 2.5 cm. long.

One of the system applications for tunable microwave filters is in Electronic Warfare (EW) systems. One of the problems in EW systems is neutralizing jamming signals. All that is required to jam a system is to send a frequency signal somewhere in the system's operational band. Typically, preselector filters at the system's front end eliminate unwanted signals from out of band and a tunable notch filter can be added to eliminate any unwanted signals which are in the band. However, adding an extra filter at the input of the system increases insertion loss which in turn decreases system performance. The extra filter also increases the system's weight and size which could be substantial based on the above-noted characteristics. This essentially is undesirable for many applications such as for systems used on aircrafts and so on. Finally, isolation is required between the two filters to insure full performance from each. The problem is magnified by one of the filters being tunable. If the notch filter operates at a fixed frequency, then the filters can be tuned to operate as a pair. In any event, since the notch changes frequencies the filter characteristics change.

Isolation can be provided at microwave frequencies by a ferrite device call an isolator. These devices require magnets and are usually relatively heavy. Therefore, the combination of a tunable notch and a bandpass filter separated by an isolator exceeds the weight and size requirements of many microwave EW systems.

It is therefore an object of the present invention to provide an improved microwave bandpass filter including an integral tunable notch filter characteristic, which avoids many of the prior art problems.

SUMMARY OF THE INVENTION

The invention incorporates a tunable notch filter as an integral part of a microwave bandpass filter. The bandpass structure employs an extra resonator and therefore there is a little increase in size and weight which is necessary to incorporate the notch filter. The apparatus of the invention provides good insertion loss which is comparable to conventional bandpass filters while the notch tuning across the operational band of the bandpass filter does not degrade or degenerate the bandpass filters performance.

DETAILED DESCRIPTION OF THE FIGURES

Figure 1:
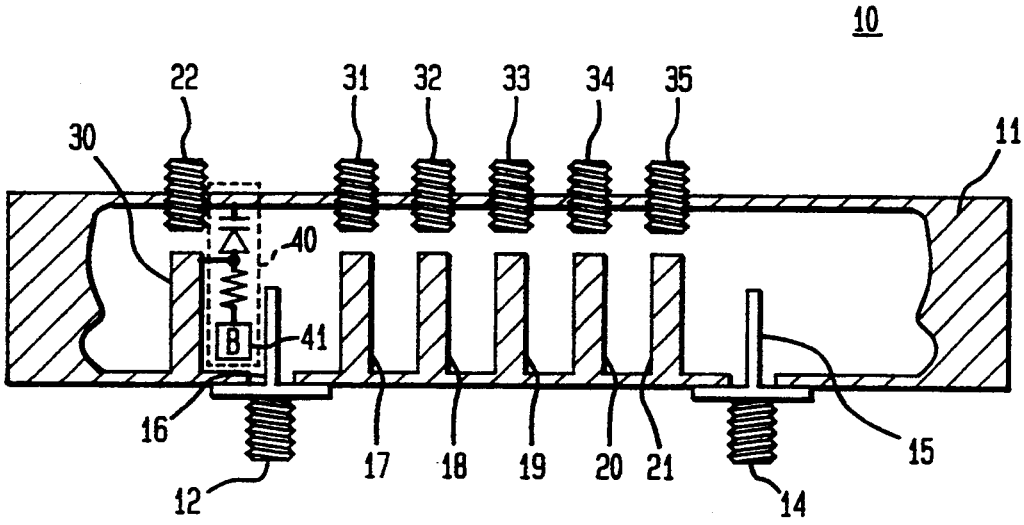
FIG. 1 is a cross-sectional side view of a bandpass filter with an integral tunable notch filter according to this invention.

FIG. 1 depicts a side view of a bandpass filter having a integral tunable notch filter according to this invention. A waveguide 11 is depicted in cross section. Essentially, waveguide 11 is sometimes referred to as a mechanically tuned cavity resonator. The construction of waveguides for microwave frequencies is extremely well known. The structure 11 can be of many equivalents such as microstrip, stripline, finline and so on. The main function of the structure 11 is to support and propagate a microwave signal to transfer the signal from an input to an output end. Shown associated with the waveguide is an input RF connector 12 which is associated with an upstanding probe 16.

Essentially the RF connector 12 is a BNC or other type of coaxial connector having a center input/output probe 16 associated therewith. As one can ascertain, the probe 16 communicates with the internal hollow of the waveguide 11. Positioned near the right end of the waveguide is another RF connector 14 associated with an input/output probe 15 generally of the same construction as the connector 12. Both connectors, as indicated, have the associated probes 15 and 16 which communicate with internal hollow of the waveguide. Disposed within the internal hollow of the waveguide and connected to one side of the waveguide are upstanding resonators as for example resonators 17, 18 19, 20 and 21. Each of the resonators operates in conjunction to one another to provide the characteristics of a bandpass filter as is well known. Each resonator is associated with a separate tuning screw such as screw 31 for resonator 17, screw 32 for resonator 18 and screw 35 for resonator 21. Each of the tuning screws, as is well known, serves to change the coupling or the effective length of the resonator. Also shown near the RF connector 12 is a resonator 30. The resonator 30 is associated with a tuning screw 22 and is a notch resonator as compared to resonator 17, 18, 19, 20 and 21 which are bandpass resonators.

Essentially, the filter structure as shown in FIG. 1 appears as a comb and is sometimes referred to as a combline bandpass filter. The filter operates in the so-called "evanescent" mode. Essentially, the operation of the filter is very similar to many waveguide filters which exist in the prior art. In the filter shown in FIG. 1 a wave which is a microwave or RF wave is launched into and out of the filter by the use of the input and output probes such as probes 16 and 15. It is noted that the filter is relatively symmetrical and therefore probe 16 can function as an input and probe 15 as an output probe or vice versa.

The probes provide a high frequency electric field which is internal to the waveguide or cavity 11. The resonator such as 17, 18, 19, 20 and 21 between the two probes 16 and 15 are tuned to the center frequency of the bandpass filter by adjusting the capacitance to the cavity wall via the tuning screws. The adjustment is made by means of the tuning screws 31 to 35. The tuning screws form a parallel plate capacitor with top portions of the resonators. The coupling between each of the resonators establishes the filter bandwidth. Thus, the filter appears as a comb like configuration and the resonators coupled by evanescently decaying electromagnetic fields or by the capacitance between the resonators. Such resonators are well known and essentially can operate in conjunction with waveguides or other supporting structures. Resonant circuits are also generally formed from short circuited lengths of transmission lines.

In any event, dimensions for such resonators are typically selected from mode charts which exist for cylindrical as well as rectangular configurations. The Q or quality factor which is obtained for some typical cavity resonators in hollow cylinder, coaxial and rectangular configurations are well known. A metal post, screw or dielectric discontinuity which is inserted in the waveguide can act as a lump circuit element and, for example, by means of the screw, shown in the Figure, one can provide tuning. See, for example, a text entitled *Electronic Engineer's Handbook*, Third Edition by D. J. Fink et al. and published by McGraw Hill, Inc. See section 9 entitled UHF and Microwave Devices. This provides a full description of various resonator configurations which can be employed in the circuit shown in FIG. 1. It also understood that while a waveguide 11 is depicted the structure 11 could be a circular cavity or any other geometrically shaped member.

Thus, the configuration consisting of resonator 17–21 between probes 12 and 14 form a typical bandpass filter arrangement. According to this invention, a resonator 30 which essentially is of the same type of resonator configuration is positioned to the left of the input connector 12 or to the left of the input probe 16. The resonator 30 forms a tunable notch which essentially provides another resonator outside the input or output probe. In this manner, the resonator 30 which is tunable by means of tuning screw 22 is outside of the physical bandpass filter. This resonator 30 is positioned so that it couples to the probe 16 and draws energy from the filter at the frequency at which the resonator is tuned. In this manner, the operation of the resonator 30 creates a notch in the bandpass of the bandpass filter. This notch can be tuned anywhere in the filter bandpass as above or below the band edges.

Figure 2:
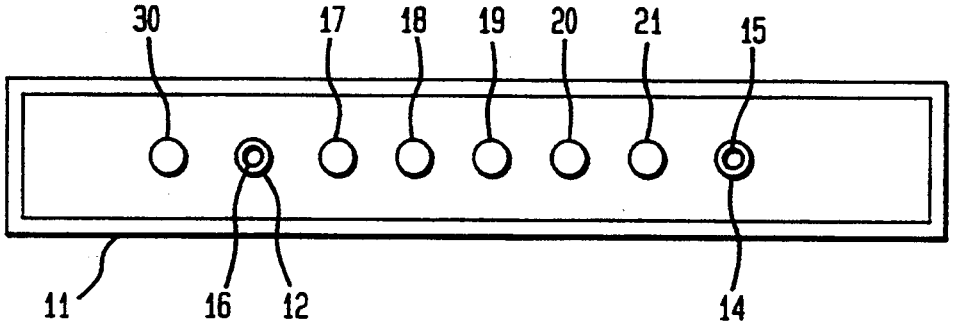
FIG. 2 is a cross-sectional view of the bandpass filter of FIG. 1 taken from the top.
Figure 3:
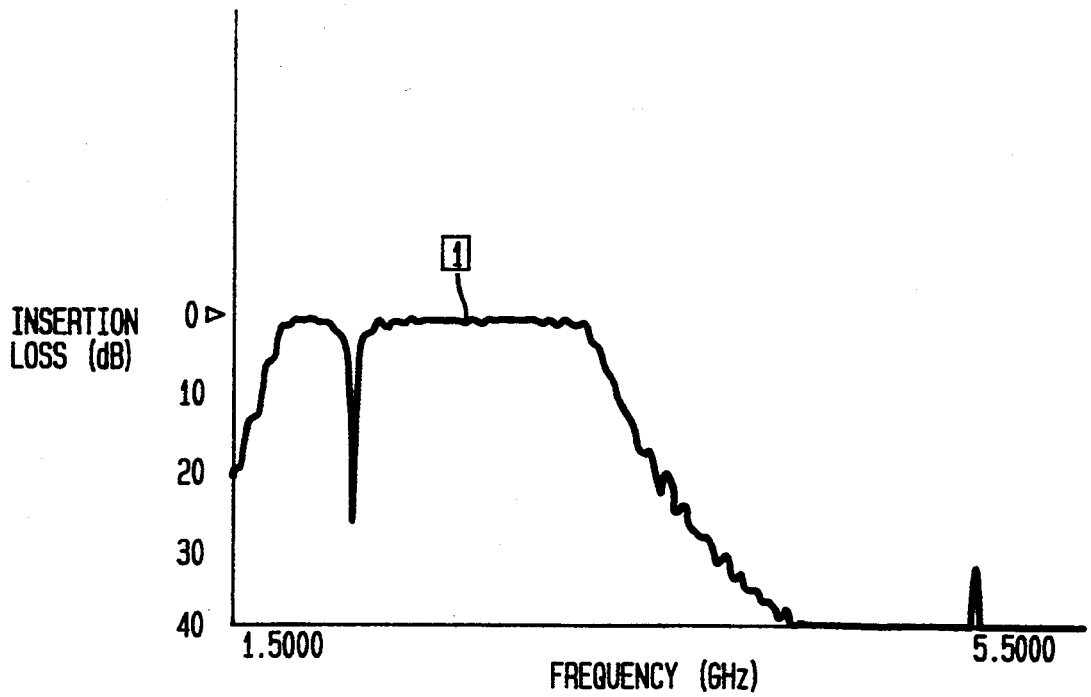
FIG. 3 is a graph depicting the insertion loss of the bandpass filter with the notch filter tuned to the lower edge of the band.
Figure 4:
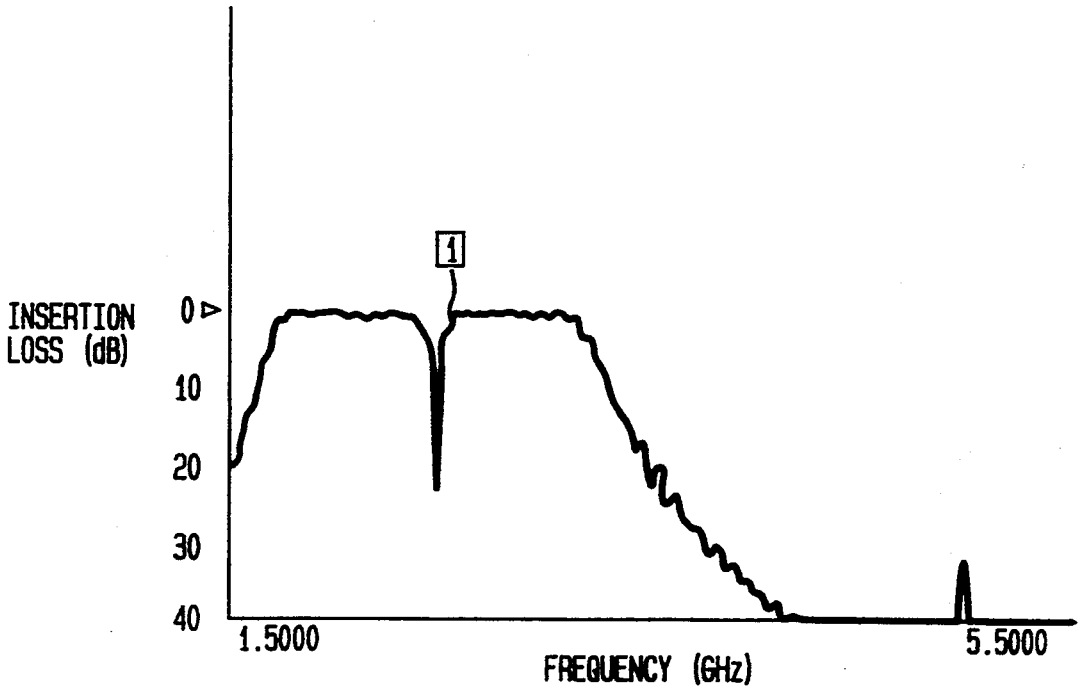
FIG. 4 is a graph depicting insertion loss of the bandpass filter with the notch tuned to the center of the band.
Figure 5:
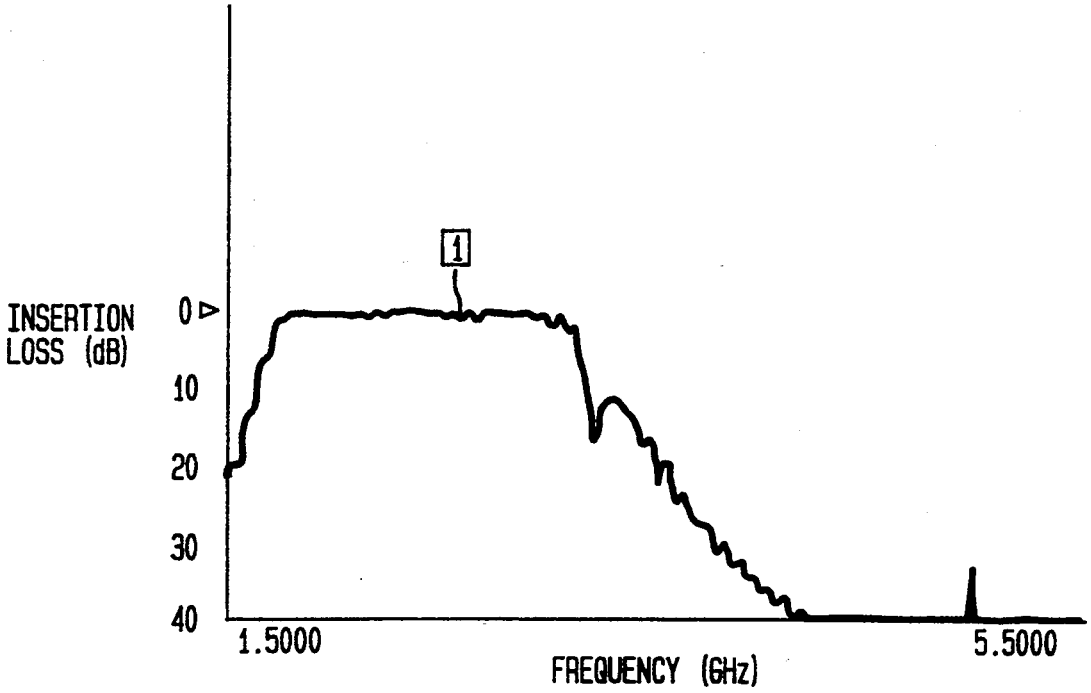
FIG. 5 is a graph depicting insertion loss of the bandpass filter with the notch tuned to the high band edge.

FIG. 2 shows a top section of the filter whereby the input probe 16 is shown as associated with the input connector 12 with the resonator 30 which is the notch resonator positioned to the left of the input probe 16 and spaced therefrom by a suitable fraction of a wavelength such as a quarter or an eighth of a wavelength. Positioned between the input/output probe 16 and input-/output probe 15 are the bandpass resonators 17, 18, 19 20 and 21 suitably spaced and each tunable. In any event, the exact structure is depicted as indicated above. As one can ascertain, the bandpass structure requires one extra resonator which is positioned outside the bandpass filter and which operates to draw power from the bandpass filter to create a notch in the bandpass filter's frequency response. FIGS. 3, 4 and 5 show data which has been obtained from a bandpass filter unit as a notch resonator 30 is tuned from the low end of the band to the high band edge. The notch in the band provides about 25 dB of rejection.

Thus, referring to FIG. 3, there is shown an insertion loss versus frequency response for the filter arrangement depicted in FIGS. 1 and 2. As one can ascertain, the frequency range extends from 1.5 GHz to about 4.5 GHz with a peak positioned at a frequency less than 5.5 GHz. As indicated, FIG. 3 depicts the insertion loss of the bandpass filter with the notch resonator 30 tuned to the low end of the band. One can see the notch very clearly in FIG. 3.

Referring to FIG. 4 there is shown the same graph with the same frequency range where the resonator 30 indicative of the notch frequency is tuned to the band center which is approximately about 2.6 GHz.

Referring to FIG. 5 there is shown the same diagram, except that the resonator 30 is now tuned to the high band edge which is at a frequency of approximately 3.6 GHz.

Figure 6:
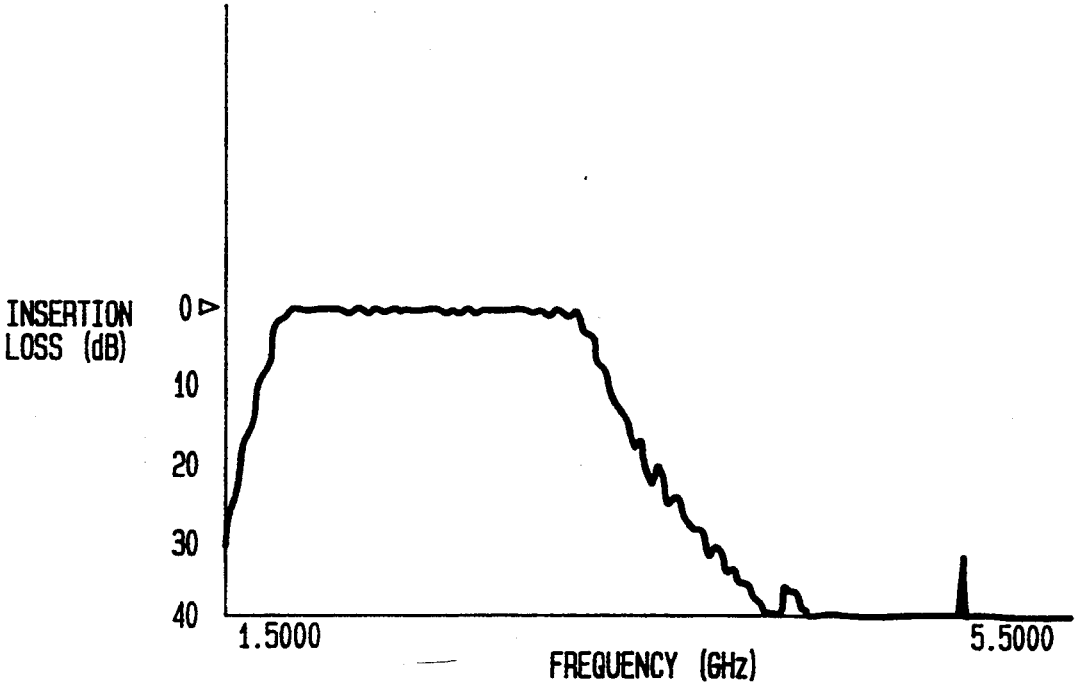
FIG. 6 is a graph depicting the insertion loss of the bandpass filter with the notch tuned to below the lower band edge.

FIG. 6 shows the bandpass response with the notch tuned well below the band demonstrating that the notch can be "parked" out of the band without disturbing the bandpass filter response. The notch resonator 30 can be tuned by mechanically adjusting the capacitance by means of screw 22 of the notch resonator or can be tuned by using a varactor. The varactor or a variable capacitance diode replaces the parallel plate capacitor so that the notch can be electronically tuned. There is shown in FIG. 1 a varactor diode 40 which has its anode electrode coupled or otherwise connected to one terminal of the resonator 30 with the cathode electrode coupled to the wall of the waveguide. Varactor 40 can be biased by means of a biasing source such as a variable voltage source 41 to thereby change the capacitance according to the applied voltage. In this manner, the resonator 30 can be tuned. In any event, adding the notch resonator 30 to the bandpass unit added approximately 10 percent to the approximate size of the filter and 8 percent to the equivalent weight of the filter. The approach of employing a resonator as 30 which acts as a notch in conjunction with a bandpass can be achieved in many of the resonator based filter realizations including microstrip, dielectric resonators, stripline, finline and so on. The approach can be utilized on monolithic microwave integrated circuits (MMICs) where the varactor and the filter are fabricated on the same substrate as presented in FIG. 11.

While the structure of FIG. 1 is employed in a waveguide or cavity type of structure it is of course understood that there are equivalents which are available in other technologies which can utilize this invention accordingly. Essentially, as indicated, the approach is based on a resonator based filter characteristics. As indicated above, it is well known how to utilize lumped element filters for the appropriate design of microwave filters. As one can ascertain, modern filter synthesis is concerned with synthesizing a polynomial which approximates a desired transducer power gain function. Since microwave filters are often based on lumped low pass filters of conventional form the relationships of microwave components in designing such filters are well known. See for example a text entitled *Microwave Semiconductor Circuit Design* by W. Alan Davis published in 1984 by Van Nostrand Reinhold Company, Inc. In particular see Chapter 3 entitled "Impedance Transformers and Filters". The technique described is to provide a tunable notch filter by adding another resonator outside the input or output probe which resonator is positioned outside the actual physical location of the bandpass filter. The notch resonator couples to the probe and pulls energy from the filter at the frequency at which the notch is tuned and at this frequency the notch in the passband filter is created.

Although this invention has been disclosed with a certain degree of particularity, it should be noted that the same has been made by way of illustration and not limitation. It would be obvious to those skilled in the art that certain modifications, alterations and changes will be within the spirit and scope of the invention as defined in the following claims.

I claim:

1. A microwave bandpass filter apparatus employing a notch in the bandpass of said filter, comprising:

a wave supporting structure for propagating a microwave signal from one input end of said structure to another output end;

input means coupled to said structure nearer said input end for launching a microwave signal to propagate in said structure;

output means coupled to said structure nearer said output end for outputting a filtered microwave signal;

resonator means positioned in said structure between said input and output ends and operative to couple microwave energy between said resonator means to provide a passband of microwave frequencies which can propagate from said input to said output ends and to thereby provide a bandpass for said filtered microwave signal and;

adjustably tunable resonator means positioned near one end of said wave supporting structure and operative to draw energy from said resonator means at a tunable frequency of said tunable resonator, to thereby create a notch in said bandpass at said tunable frequency, said adjustably tunable resonator means being selectively tunable across a range of frequencies greater than said passband of microwave frequencies, wherein said tunable frequency is locatable within said passband or outside said passband, whereby said notch can be removed from said bandpass without disturbing the filter response from said resonator means, wherein said adjustably tunable resonator means includes a variable capacitor device to alter the capacitance and hence the tuned frequency of said tunable resonator.

2. The microwave bandpass filter apparatus according to claim 1, wherein said wave supporting structure is a waveguide.

3. The microwave bandpass filter apparatus according to claim 2, wherein said resonator means comprises a plurality of resonators positioned in the internal hollow of said waveguide, each resonator extending from one common longitudinal wall of said waveguide towards another longitudinal wall opposite said common wall and spaced apart to form a bandpass filter where microwave energy is selectively filtered by said resonators according to said passband of microwave frequencies of said resonators.

4. The microwave bandpass filter apparatus according to claim 3, wherein said another common wall includes a plurality of tuning means each one associated with a separate resonator of said plurality of resonators, whereby each said separate resonator can be tuned by said associated tuning means.

5. The microwave bandpass filter apparatus according to claim 4, wherein said tuning means is an adjustable screw which can be moved in directions towards or away from said resonators to vary the capacitance of the resonator to the waveguide cavity wall.

6. The microwave bandpass filter apparatus according to claim 1, wherein said input means is an upstanding probe coupled to a microwave connector and operative to launch an microwave signal coupled to said connector to propagate in said structure.

7. The microwave bandpass filter apparatus according to claim 6, further including another probe coupled nearer said output end of said structure.

8. The microwave bandpass filter apparatus according to claim 7, wherein said adjustably tunable resonator means is positioned on a side of said upstanding probe furthest from said resonator means.

9. A microwave bandpass filter apparatus employing a notch in the bandpass of said filter, comprising:

a wave supporting structure for propagating a microwave signal from one input end of said structure to another output end;

input means coupled to said structure nearer said input end for launching a microwave signal to propagate in said structure;

output means coupled to said structure nearer said output end for outputting a filtered microwave signal;

resonator means positioned in said structure between said input and output ends and operative to couple microwave energy between said resonator means to provide a passband of microwave frequencies which can propagate from said input to said output ends and to thereby provide a bandpass for said filtered microwave signal and;

adjustably tunable resonator means positioned near one end of said wave supporting structure and operative to draw energy from said resonator means at a tunable frequency of said tunable resonator, to thereby create a notch in said bandpass at said tunable frequency, said adjustably tunable resonator means being selectively tunable across a range of frequencies greater than said passband of microwave frequencies, wherein said tunable frequency is locatable within said passband or outside said passband, whereby said notch can be removed from said bandpass without disturbing the filter response from said resonator means, wherein wave supporting structure is a waveguide and said adjustably tunable resonator means is tuned by means of a screw located in a wall of said waveguide to vary the capacitance and therefor the tuning of said tunable resonator.

10. A microwave bandpass filter apparatus employing a notch in the bandpass of said filter, comprising:

a wave supporting structure for propagating a microwave signal from one input end of said structure to another output end;

input means coupled to said structure nearer said input end for launching a microwave signal to propagate in said structure;

output means coupled to said structure nearer said output end for outputting a filtered microwave signal;

resonator means positioned in said structure between said input and output ends and operative to couple microwave energy between said resonator means to provide a passband of microwave frequencies which can propagate from said input to said output ends and to thereby provide a bandpass for said filtered microwave signal and;

adjustably tunable resonator means positioned near one end of said wave supporting structure and operative to draw energy from said resonator means at a tunable frequency of said tunable resonator, to thereby create a notch in said bandpass at said tunable frequency, said adjustably tunable resonator means being selectively tunable across a range of frequencies greater than said passband of microwave frequencies, wherein said tunable frequency is locatable within said passband or outside said passband, whereby said notch can be removed from said bandpass without disturbing the filter response from said resonator means, wherein said adjustably tunable resonator means includes at least one varactor diode coupled between a terminal of said adjustably tunable resonator means and a wall of said wave supporting structure, said varactor being coupled to a variable voltage source to change the capacitance of said varactor according to an applied voltage from said voltage source.

11. The microwave bandpass filter apparatus according to claim 9, wherein said wave supporting structure is a waveguide.

12. The microwave bandpass filter apparatus according to claim 11, wherein said resonator means comprises a plurality of resonators positioned in the internal hollow of said waveguide, each resonator extending from one common longitudinal wall of said waveguide towards another longitudinal wall opposite said common wall and spaced apart to form a bandpass filter where microwave energy is selectively filtered by said resonators according to said passband of microwave frequencies of said resonators.

13. The microwave bandpass filter apparatus according to claim 12, wherein said another common wall includes a plurality of tuning means each one associated with a separate resonator of said plurality of resonators, whereby each said separate resonator can be tuned by said associated tuning means.

14. The microwave bandpass filter apparatus according to claim 13, wherein said tuning means is an adjustable screw which can be moved in directions towards or away from said resonators to vary the capacitance of the resonator to the waveguide cavity wall.

15. The microwave bandpass filter apparatus according to claim 9, wherein said input means is an upstanding probe coupled to a microwave connector and operative to launch a microwave signal coupled to said connector to propagate in said structure.

16. The microwave bandpass filter apparatus according to claim 15, further including another probe coupled nearer said output end of said structure.

* * * * *